US009470039B2

(12) United States Patent
Mitchell

(10) Patent No.: US 9,470,039 B2
(45) Date of Patent: Oct. 18, 2016

(54) ARCHITECTURAL MESH FRAMING SYSTEM

(71) Applicant: CAMBRIDGE INTERNATIONAL INC., Cambridge, MD (US)

(72) Inventor: James J. Mitchell, Cambridge, MD (US)

(73) Assignee: Cambridge International, Inc., Cambridge, MD (US)

( * ) Notice: Subject to any disclaimer, the term of this patent is extended or adjusted under 35 U.S.C. 154(b) by 0 days.

(21) Appl. No.: 14/218,049

(22) Filed: Mar. 18, 2014

(65) Prior Publication Data

US 2014/0262085 A1 Sep. 18, 2014

Related U.S. Application Data

(60) Provisional application No. 61/800,315, filed on Mar. 15, 2013.

(51) Int. Cl.
*E06B 9/01* (2006.01)
*E06B 9/52* (2006.01)

(52) U.S. Cl.
CPC ... *E06B 9/01* (2013.01); *E06B 9/52* (2013.01)

(58) Field of Classification Search
CPC ..... A47G 5/00; B44D 3/185; D06C 3/08
USPC ..... 160/375, 376
See application file for complete search history.

(56) References Cited

U.S. PATENT DOCUMENTS

| | | | | |
|---|---|---|---|---|
| 3,507,062 | A * | 4/1970 | Moyer | 38/102.91 |
| 3,553,862 | A * | 1/1971 | Hamu | 38/102.1 |
| 3,962,805 | A * | 6/1976 | Hamu | 38/102.5 |
| 4,127,156 | A * | 11/1978 | Brandt | 160/179 |
| 4,660,308 | A * | 4/1987 | Dang et al. | 38/102.4 |
| 5,046,545 | A * | 9/1991 | Loomis et al. | 160/368.1 |
| 5,983,790 | A * | 11/1999 | Switzer et al. | 101/127.1 |
| D483,953 | S | 12/2003 | Ripple | |
| 6,886,300 | B2 * | 5/2005 | Hudoba et al. | 52/222 |
| 7,735,541 | B2 * | 6/2010 | Ocampo | 160/374 |
| 7,779,888 | B2 | 8/2010 | Messick, Jr. et al. | |
| 8,006,739 | B2 | 8/2011 | Costello | |
| 8,936,065 | B1 * | 1/2015 | Gillespie | 160/371 |
| 2007/0144101 | A1 * | 6/2007 | Costello | 52/633 |
| 2010/0206496 | A1 * | 8/2010 | Ninaber | 160/372 |

* cited by examiner

*Primary Examiner* — Katherine Mitchell
*Assistant Examiner* — Scott Denion
(74) *Attorney, Agent, or Firm* — Buchanan, Ingersoll & Rooney PC

(57) ABSTRACT

A framed architectural mesh panel system including a mesh panel; a frame assembly; and a tensioning system; wherein the tensioning system is integrated within the frame assembly.

7 Claims, 5 Drawing Sheets

ARCHITECTURAL MESH FRAMING SYSTEM

TECHNICAL FIELD

This disclosure is directed to an architectural mesh panel, and more particularly to a framed architectural mesh panel with an integrated tensioning system.

BACKGROUND OF THE DISCLOSURE

Architectural mesh panels add an aesthetic look to a building façade while also adding additional benefits such as security, fall protection, and ventilation. Large mesh panels such as those spanning the heights of building can be used, for example, on parking garages in order to improve the appearance thereof. These large mesh panels are typically manufactured from a flexible mesh, such as that utilized in conveyor belts, and require a tensioning system to apply pre-tension to the mesh panel in order to keep the mesh taught so that it can withstand large wind loads. An example of such an architectural mesh system is shown in U.S. Pat. No. 7,779,888 to Cambridge International, Inc., the contents of which are hereby incorporated by reference.

In contrast, smaller framed mesh panels of rigid architectural mesh are typically used as wall panels, ceiling panels, room dividers, handrail in-fill panels, elevator wall panels, and the like. An example of an architectural mesh used in a smaller rigid panel is shown in U.S. Pat. No. D483,953 to Cambridge International, Inc., the contents of which are hereby incorporated by reference. The rigid nature required for these panels prevents a flexible mesh from being utilized in these applications because the typical mesh tensioning system is too bulky to fit inside of the conventional framing components.

Accordingly, there exists a need in the marketplace for a mesh panel system with a self-contained tensioning system integral to a frame such that the tension required to utilize flexible mesh can be applied. The advantages of utilizing a flexible mesh in a framed mesh panel include a greater variety of available mesh patterns and appearances, lower costs, lighter weight, increased ventilation, and light transparency.

SUMMARY

A framed architectural mesh panel system includes a mesh panel, a frame assembly, and a tensioning system integrated within the frame assembly.

BRIEF DESCRIPTION OF THE DRAWING FIGURES

These and other objects, features, and advantages of the invention will become more readily apparent to those skilled in the art upon reading the following detailed description, in conjunction with the appended drawings in which.

DETAILED DESCRIPTION

Figure 1:
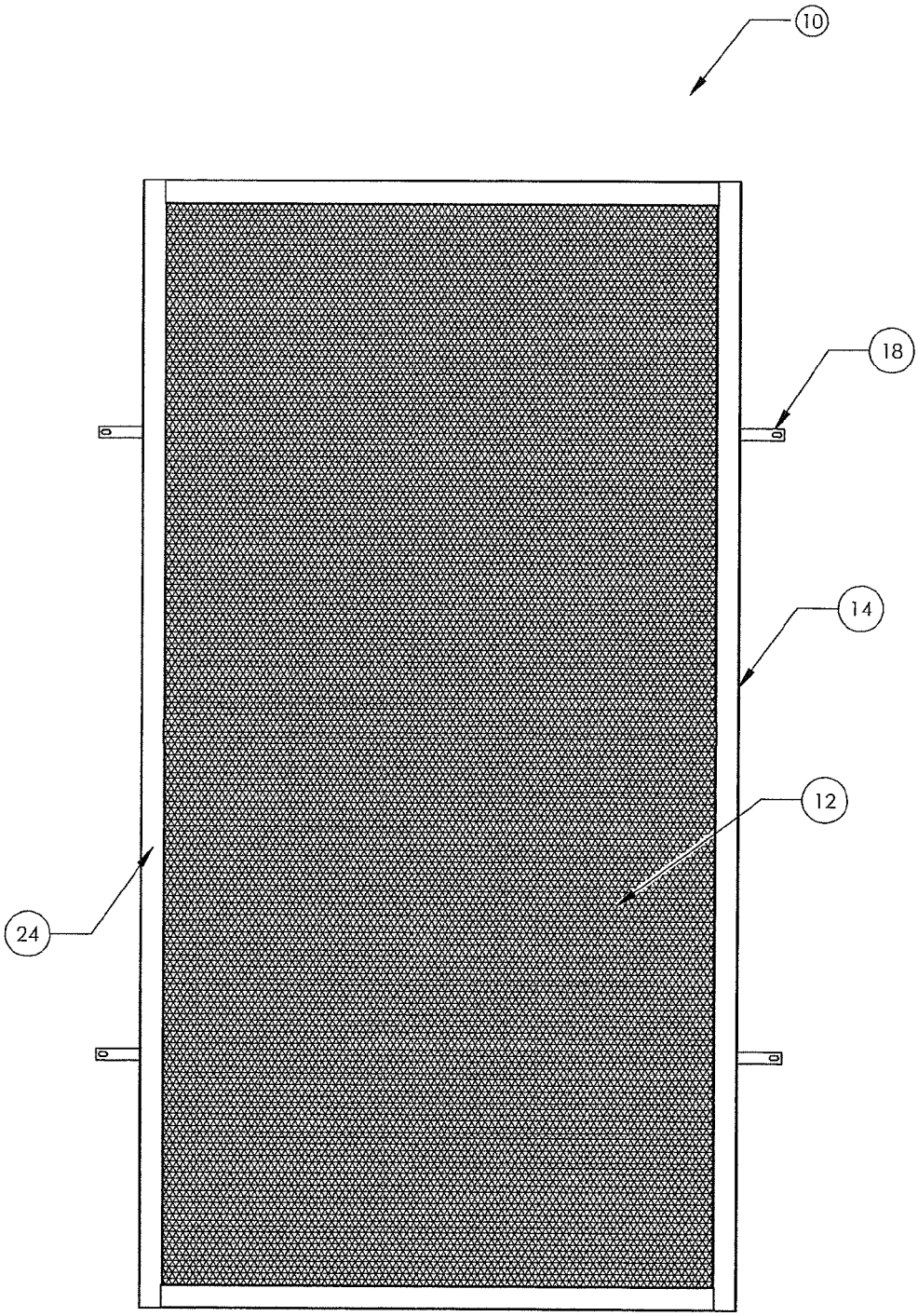
FIG. 1 is a front view of an architectural mesh framing system according to an embodiment of the disclosure.
Figure 2:
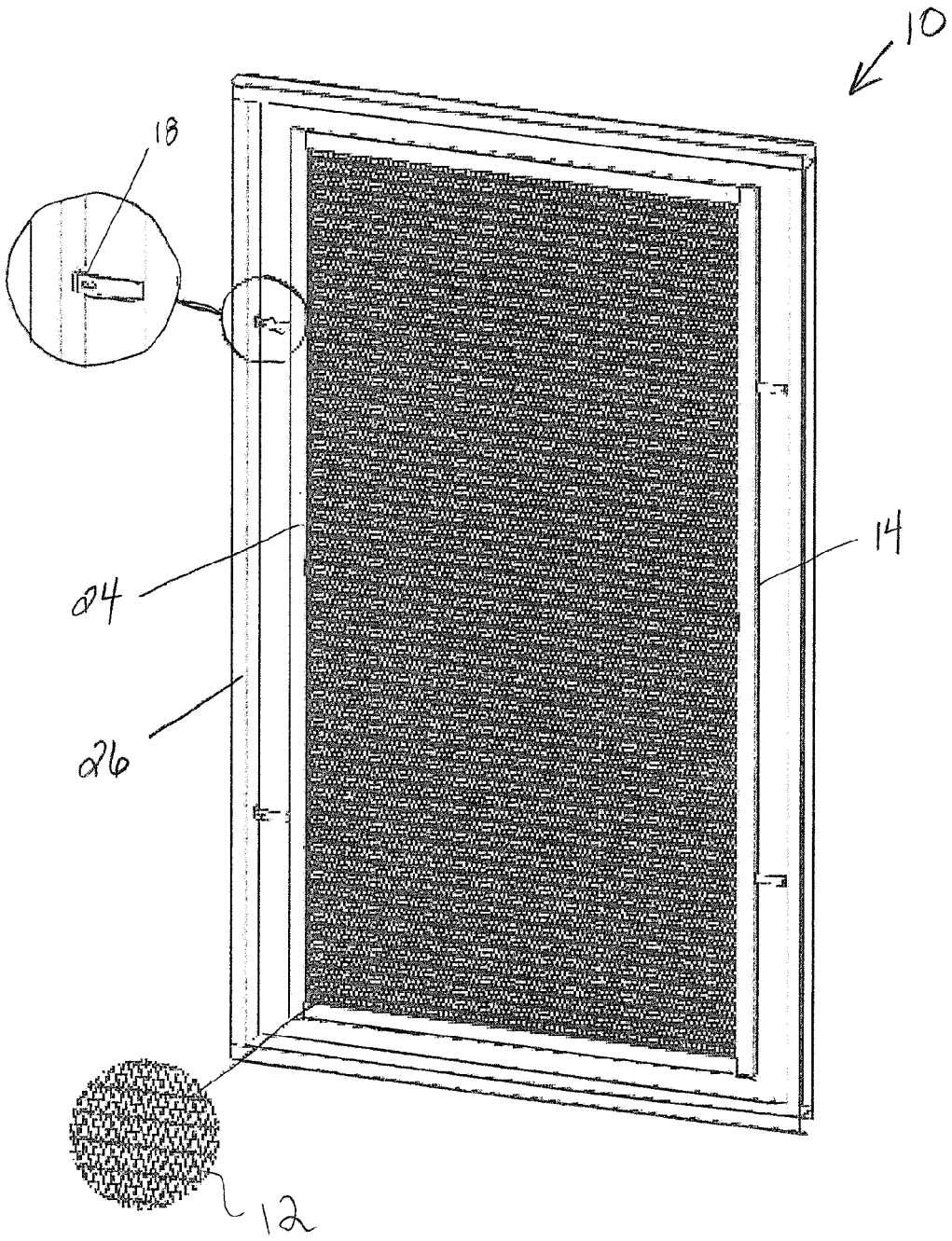
FIG. 2 is a perspective view of the architectural mesh framing system mounted within a support structure.
Figure 3:
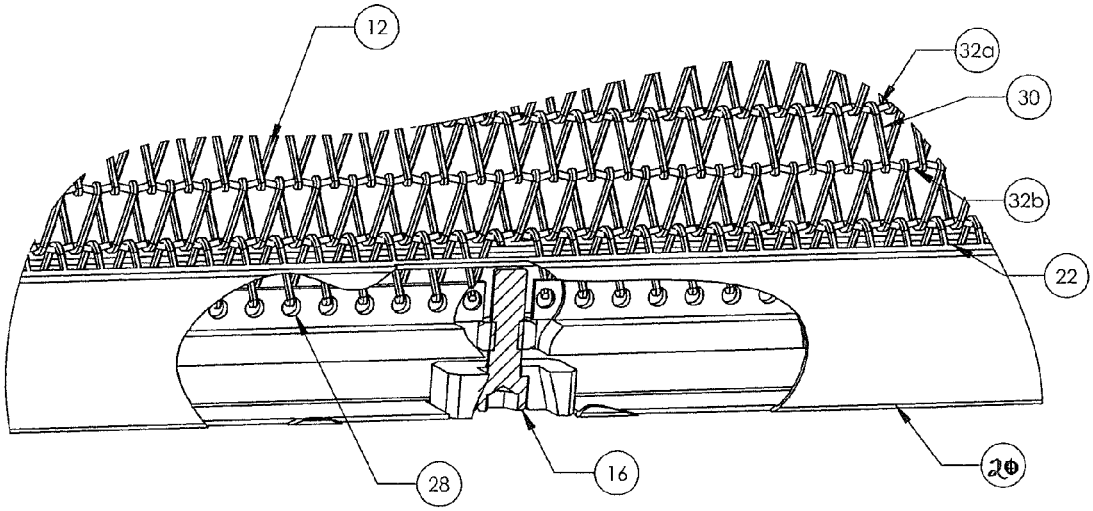
FIG. 3 is an enlarged view of the architectural mesh within the framing system.

This disclosure is directed to a framed architectural mesh panel system 10, as shown generally in FIGS. 1-3. The system 10 includes a mesh panel 12, a frame assembly 14, a tensioning system 16, and attachment clips 18. The frame assembly 14 comprises a plurality of hollow structural steel tubing 20 with a slit 22 cut on the inner periphery in order to receive the edge of the mesh panel 12. Sections of the tubing 20 are cut to allow insertion of the mesh panel 12, mounting of components of the tensioning system 16 and to allow assembly of the steel tubing 20 to form a frame 24 having the desired size and configuration. The frame tubing 20 is typically stainless steel but it could of course be fabricated from other materials, and powder coated, if desired. Attachment clips 18 are welded onto the frame 24 for securing the frame 24 to the intended mounting surface or structure 26.

The architectural mesh panel 12, as shown best in FIG. 3, is woven to a predetermined width and has the uppermost and lower edges defined by a plurality of loops 28. A single helically-wound spiral wire 30 is associated with two connector crimp rods 32*a*, 32*b* positioned to be sequentially adjacent in the vertical direction of the mesh panel 12 and to define a spiral unit. Horizontal crimp rods 32*a*, 32*b* are inserted into the woven spirals 30 to join the individual spirals together into a panel 12. The terminal ends of the crimp rods are welded to make the assembly permanent. The mesh 12 can be woven with a variety of different wire sizes, pitches, and directions to produce a large variety of patterns. Further details of possible woven mesh patterns are described, for example, in U.S. Pat. No. 8,006,739 to Cambridge International, Inc., the contents of which are hereby incorporated by reference. U.S. Pat. No. 8,006,739 describes an architectural mesh with a combination of various mesh patterns, however, it will be apparent to one skilled in the art that a single mesh pattern or any combination thereof could of course be utilized in the framing system disclosed herein. The mesh material is typically stainless steel but can be manufactured with a number of different metallic alloys for different appearances.

Figure 4:
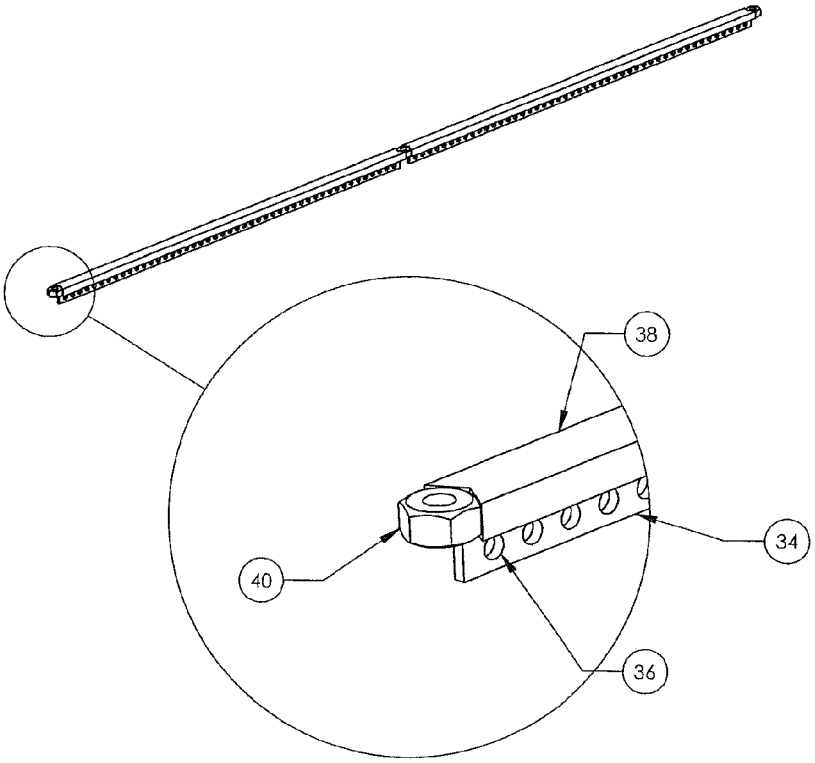
FIG. 4 is a schematic illustration of a tension bar in the architectural mesh framing system.

With reference to FIG. 4, tensioning system 16 is used to keep the mesh panel taught and straight. The tensioning system 16 includes a plurality of flat tension bar sections 34 with holes 36 to match the pattern of loops on the connection spiral 30. These sections are welded to the backing bar 38 giving the assembly the strength and rigidity to withstand the tension forces exerted on the mesh panel 12. Tension nuts 40 are welded at different sections along the backing bar 38. The number and spacing of these nuts are determined by the size of the mesh panel 12.

Figure 6:
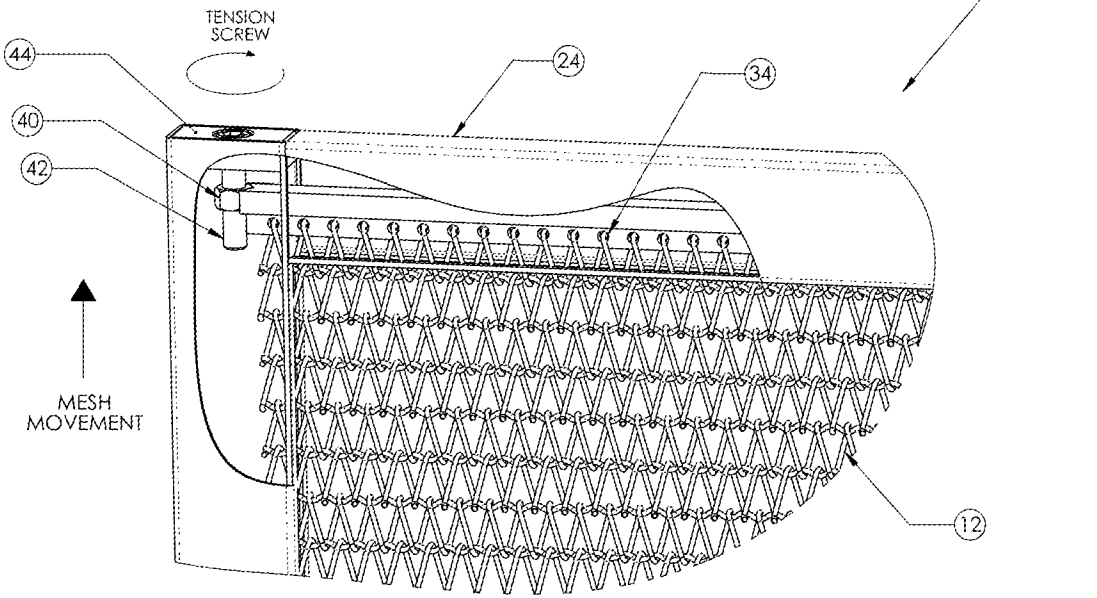
FIG. 6 is a schematic illustration of tensioning the architectural mesh framing system.

The connecting spirals 30 of the mesh panel are rotated onto and through the holes 36 in the tension bars 34, thereby joining the mesh panel 12 to the tensioning system 16. The mesh panel 12 and tension bars 34 are inserted into the frame assembly 14 and the frame 24 is welded together. Screws 42 are inserted into fittings 44 on the top and bottom of the frame 24 and threaded into the tension nuts 40 on the tension bar assembly 34, as best shown in FIG. 6. The number and size of the fittings 44 are determined by the size of the frame 14.

Figure 5A:
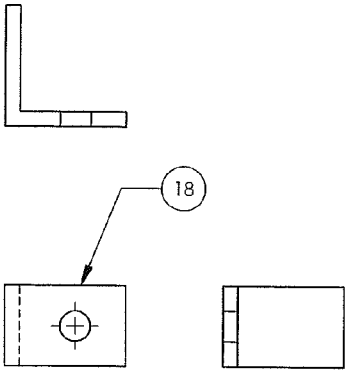
FIGS. 5A and 5B are illustrations of attachment clips used in the architectural mesh framing system.
Figure 5B:
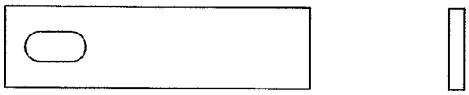

Referring also to FIGS. 5A and 5B, the framed architectural mesh panel 10 can be secured onto a mounting surface or structure 26 with a variety of attachment clips 18, tabs, or fasteners. These clips can be designed to match existing clips or environment. The attachments can be mounted along the periphery of the frame edges or along the back side if the frame is mounted flush on a wall or ceiling. The size and number of attachment clips 18 is determined by the weight of the frame assembly and the availability of existing clips and structure.

The framed architectural mesh panel 10 is tensioned as shown in FIG. 6 by tightening the screws 42 in the fittings 44 located along either end of the frame 24. The mesh panel 12, connected to the tension bar 34, is drawn in opposite directions towards the top and bottom of the frame 24. This tension removes slack from the mesh panel 12 keeping the mesh spirals 30 in crimp and results in a uniform appearance.

While the present invention has been described with respect to a particular embodiment of the present disclosure, this is by way of illustration for purposes of disclosure rather than to confine the invention to any specific arrangement as there are various alterations, changes, deviations, eliminations, substitutions, omissions and departures which may be made in the particular embodiment shown and described without departing from the scope of the claims.

What is claimed is:

1. A framed architectural mesh panel system comprising:

a mesh panel having an outer perimeter edge;

a frame assembly comprising a hollow tubing having a slit along an inner periphery thereof for mounting said mesh panel; and a tensioning system;

wherein the tensioning system is integrated within the hollow tubing; and wherein said tensioning system comprises at least one backing bar segment, at least one flat tension bar segment welded perpendicularly to said at least one backing bar segment, the at least one flat tension bar segment including a plurality of holes for mounting said mesh panel to an edge of the at least one flat tension bar segment, a plurality of tension nuts, with a respective tension nut disposed at a first end and a second end of each said at least one backing bar segment, and a tensioning member extending through the hollow tubing and into one of said plurality of tension nuts such that said tensioning member draws said outer perimeter edge of said mesh panel toward said hollow tubing.

2. The framed architectural mesh panel system of claim 1, wherein said slit is configured to receive said tensioning system and said outer perimeter edge of said mesh panel.

3. The framed architectural mesh panel system of claim 2, wherein said mesh panel comprises a plurality of helically wound spiral wires defining a plurality of loops and a plurality of connector rods interconnecting the helically wound spiral wires.

4. The framed architectural mesh panel system of claim 3, wherein said plurality of holes correspond to said plurality of loops on said mesh panel such that said loops extend through said holes and thereby join said mesh panel to said at least one tension bar segment.

5. The framed architectural mesh panel system of claim 1, wherein said frame assembly includes a plurality of fittings disposed along an exterior of said hollow tubing, said fittings configured for receiving the tensioning member.

6. The framed architectural mesh panel system of claim 5, wherein said tensioning member extends through one of said plurality of fittings and into one of said plurality of tension nuts.

7. The framed architectural mesh panel system of claim 4, wherein said at least one tension bar segment includes a first tension bar disposed along an upper edge of said mesh panel and a second tension bar segment disposed along a lower edge of said mesh panel.

* * * * *